US006719288B2

(12) United States Patent
Hessing et al.

(10) Patent No.: US 6,719,288 B2
(45) Date of Patent: Apr. 13, 2004

(54) REMOTE CONTROLLED MULTIPLE MODE AND MULTI-GAME CARD SHUFFLING DEVICE

(75) Inventors: Lynn Hessing, Boise, ID (US); Daniel Mahoney, Star, ID (US); Steven J. Blad, Henderson, NV (US)

(73) Assignee: VendingData Corporation, Las Vegas, NV (US)

( * ) Notice: Subject to any disclaimer, the term of this patent is extended or adjusted under 35 U.S.C. 154(b) by 0 days.

(21) Appl. No.: 10/050,632

(22) Filed: Jan. 18, 2002

(65) Prior Publication Data

US 2002/0113368 A1 Aug. 22, 2002

Related U.S. Application Data

(63) Continuation-in-part of application No. 09/394,988, filed on Sep. 13, 1999, which is a continuation-in-part of application No. 09/392,108, filed on Sep. 8, 1999, now Pat. No. 6,293,546.

(60) Provisional application No. 60/152,874, filed on Sep. 8, 1999.

(51) Int. Cl.[7] ..... A63F 1/12

(52) U.S. Cl. ..... 273/149 R; 273/274; 273/138; 273/292; 463/12; 463/13; 463/37

(58) Field of Search ..... 273/149 R, 274, 273/292, 138; 463/12, 13, 37

(56) References Cited

U.S. PATENT DOCUMENTS

| | | | | | |
|---|---|---|---|---|---|
| 4,108,361 | A | | 8/1978 | Krause | |
| 4,310,160 | A | * | 1/1982 | Willette et al. | 271/219 |
| 4,497,488 | A | * | 2/1985 | Plevyak et al. | 273/149 R |
| 4,513,969 | A | * | 4/1985 | Samsel, Jr. | 273/149 R |
| 4,531,187 | A | | 7/1985 | Uhland | |
| 4,586,712 | A | * | 5/1986 | Lorber et al. | 221/224 |
| 4,770,421 | A | * | 9/1988 | Hoffman | 273/149 R |
| 4,773,098 | A | | 9/1988 | Scott | |
| 4,832,342 | A | * | 5/1989 | Plevyak et al. | 273/149 R |
| 4,951,950 | A | | 8/1990 | Normand et al. | |
| 5,096,197 | A | * | 3/1992 | Embury | 273/149 R |
| 5,110,134 | A | | 5/1992 | Laughlin et al. | |
| 5,199,710 | A | | 4/1993 | Lamle | |
| 5,261,667 | A | * | 11/1993 | Breeding | 273/149 R |
| 5,397,128 | A | | 3/1995 | Hesse et al. | |
| 5,531,443 | A | * | 7/1996 | Cruz | 463/37 |
| 5,575,475 | A | * | 11/1996 | Steinbach | 273/149 R |
| 5,584,483 | A | * | 12/1996 | Sines et al. | 273/149 R |
| 5,586,766 | A | | 12/1996 | Forte et al. | |
| 5,586,936 | A | | 12/1996 | Bennett et al. | |
| 5,676,372 | A | * | 10/1997 | Sines et al. | 273/149 R |
| 5,690,337 | A | * | 11/1997 | Somma et al. | 273/309 |
| 5,692,748 | A | * | 12/1997 | Frisco et al. | 273/149 R |
| 5,695,189 | A | * | 12/1997 | Breeding et al. | 273/149 R |
| 5,941,769 | A | * | 8/1999 | Order | 273/149 R |
| 6,019,368 | A | * | 2/2000 | Sines et al. | 273/149 R |
| 6,019,374 | A | * | 2/2000 | Breeding | 273/292 |
| 6,019,680 | A | * | 2/2000 | Cheng | 273/148 B |
| 6,068,258 | A | * | 5/2000 | Breeding et al. | 273/149 R |
| 6,102,402 | A | * | 8/2000 | Scott et al. | 273/274 |
| 6,139,014 | A | * | 10/2000 | Breeding et al. | 273/149 R |
| 6,149,154 | A | * | 11/2000 | Grauzer et al. | 273/149 P |
| 6,217,447 | B1 | | 4/2001 | Lofink et al. | |
| 6,254,096 | B1 | * | 7/2001 | Grauzer et al. | 273/149 R |
| 6,293,546 | B1 | * | 9/2001 | Hessing et al. | 273/138.1 |
| 6,325,373 | B1 | * | 12/2001 | Breeding et al. | 273/149 R |
| 6,356,145 | B1 | * | 3/2002 | Inada | 329/304 |

* cited by examiner

*Primary Examiner*—Benjamin H. Layno
*Assistant Examiner*—Dolores Collins
(74) *Attorney, Agent, or Firm*—Rob L. Phillips; Quirk & Tratos

(57) ABSTRACT

The present invention features a card shuffling machine having a controller that can be operated remote from the shuffling machine. A remote control unit is provided for remotely communicating operator-selected commands to the shuffling machine. The shuffling machine is capable of shuffling and dealing various games and between different modes of operation, including batch mode and continuous mode. The remote control unit includes a housing, a controller disposed therein, a display in electrical communication with the controller, and at least one user-operated key in electrical communication with the controller for electrically communicating a shuffle command to said shuffling machine allowing the dealer to select between various modes of operation, including batch mode, continuous mode, and between various games to be played.

18 Claims, 15 Drawing Sheets

REMOTE CONTROLLED MULTIPLE MODE AND MULTI-GAME CARD SHUFFLING DEVICE

RELATED APPLICATIONS

This application is a continuation in part of application Ser. No. 09/394,988, entitled "Multiple Mode Card Shuffling Device", filed Sep. 13, 1999; which is a continuation in part of application Ser. No. 09/392,108, entitled "Remote Controller Device for Shuffling Machine", filed Sep. 8, 1999, now U.S. Pat. No. 6,293,546, and claims priority from provisional patent application serial No. 60/152,874, entitled "Multiple Mode Card Shuffling Device", filed Sep. 8, 1999.

BACKGROUND OF THE INVENTION

1. Field of the Invention

The present invention relates to the field of automatic shuffling machines and, more particularly to a multiple mode card shuffling device.

2. Discussion of the Prior Art

Casinos, cardrooms and other gaming establishments employ many card dealers. The dealers shuffle cards, deal the cards, take bets and otherwise play the card game. Substantial amounts of the dealers' time is spent in just shuffling the decks of cards in preparation for the ensuing card hands. During the time the dealer is shuffling, the game table is inactive, and bets are not being placed. From the standpoint of the casino, it is desirable to minimize the time spent in preparing the card decks for additional play.

A number of prior art card deck shuffling machines have been invented. Most of the prior automatic shufflers have suffered from various problems. Many are relatively slow and do not help the basic problem encountered by the gaming establishment. Others are relatively complex and thus expensive to build and maintain.

Furthermore, with respect to prior art shufflers, the control panel that the dealer must operate to start, stop, etc., the shuffler is located directly on the shuffler. Because of the orientation of many tables in casinos, cardrooms, etc., it is inefficient and burdensome for the dealer to have to turn and press the buttons and commands associated therewith on many prior art shufflers.

In the card shuffling arts, two types of shufflers have been introduced. One is a batch mode shuffler; the other is a continuous mode shuffler.

The batch mode shuffler is a device that shuffles a deck or multiple decks of playing cards into a random order. The deck or decks are at one time loaded into the shuffler, usually into an input bin. The cards are shuffled or re-ordered and presented to the output bin. The decks are removed all at once by a person (dealer) who divides the stack of cards, records (cuts) them, and places a marked cut card in the deck in a random position. The dealer then places the cards into a dealing shoe for individual dealing to players in a card game.

At the conclusion of each game, the hands of the cards that have been played by the players are collected and discarded face down by the dealer into a discarded shoe. The decks are then placed into the input bin of the shuffling mechanism to be re-shuffled to begin a new game. This process may include 2 sets of decks of different color card backs. One set would be shuffling while the other is being played. This reduces the time the game is stopped for shuffling, allowing the dealer to play more hands with the players.

The continuous shuffler is a device that shuffles or re-orders a deck or multiple decks of playing cards into a random order. In the use of this mechanism, the cards are constantly being shuffled by the device. At the end of each game, the cards are discarded directly into the input bin of the continuous shuffler. The dealing shoe is generally built into the output bin of the shuffler. The shuffling never stops as long as the game is being played or being prepared to play. There is no need for a cut card or dealing or discard shoes. The shuffler input and output bins act as the shoes. This mechanism can use a single deck of cards in a black jack game without fear of "card counters" taking advantage of the game. The reason for this is that the cards are continuously discarded at the end of each game back into the input of the shuffler.

Thus, there remains a strong need for a controller for a shuffling machine that can be operated remote from the shuffling machine having a multiple mode capability for allowing the dealer to select between various modes of operation, including batch mode, continuous mode, and between various games to be played.

SUMMARY OF THE PREFERRED EMBODIMENTS

In accordance with an aspect of the present invention, there is provided a card shuffling machine that includes at least two modes of operation and a selector for selecting between the two modes of operation. A method of operating the electronic playing card shuffling machine to cause the machine to operate in at least two different shuffling modes is also provided. The keypad controller allows the dealer to select the shuffling mode and game(s). When a continuous mode has been selected, the dealer places a deck of cards in the input tray and selects the number of cards to be randomly selected from the input tray (i.e., 20, 10, or 5) depending on the number of players at the game. If the dealer selects a batch mode shuffler from the keypad, then the shuffler is used in batch mode, for example as described in U.S. application Ser. No. 08/847,232. The stop and start functions are controlled from the remote keypad. The cards are all placed in the input tray (1–8 decks), and start is pushed. The decks are all randomly re-ordered until all cards are completely ejected from the input into the output collection tray. The dealer removes the cards and hand deals from a dealing shoe on the playing table.

In accordance with yet another aspect of the present invention, there is provided a method for operating an electronic playing card shuffling machine. The method includes the steps of locating a control unit remote from the shuffling machine, and operating the control unit to cause the shuffling machine to perform at least one function.

In accordance with one aspect of the present invention, there is provided a remote control unit for remotely communicating commands, such as start shuffling, to the shuffling machine. The remote control unit also includes a controller in electrical communication with the key(s) for communicating the commands to the shuffling machine. The remote control unit also includes a display in electrical communication with the controller for displaying output information to the operator.

In accordance with another aspect of the present invention, there is provided a remote control unit in communication with a shuffling machine. In a preferred embodiment, the remote control unit includes a cord having a first end connected to the remote control unit and a second end connected to the shuffling machine. The cord includes circuitry that communicates between the remote control unit and the shuffling machine. In other preferred embodiments the cord is omitted, and commands are communicated via infrared or radio frequency transmitter/receivers.

In accordance with yet another aspect of the present invention, there is provided a method for switching modes of operation of a card shuffling machine having at least two modes of operation. The method includes the steps of receiving a selection command from a selection switch, and selecting one of the modes of operation for the card shuffling machine based on the selection command.

In accordance with yet another aspect of the present invention, there is provided a card shuffling machine that selectively shuffles cards for at least two different card games having different shuffling requirements and between at least two selectable modes of operation being defined by at least the two different card games.

The system of the present invention allows multiple mode shuffling (e.g., continuous or batch) for the same device by the use of a remote keypad and software in the shuffler. Another use is for specialty game play as described in U.S. application Ser. No. 08/847,232. Specialty game play as it applies to remote control of multiples mode is described in U.S. application Ser. No. 09/394,988.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

A complete understanding of the present invention may be obtained by reference to the accompanying drawings, when taken in conjunction with the detailed description thereof and in which.

Like numerals refer to like parts throughout the several views of the drawings.

DETAILED DESCRIPTION OF THE PREFERRED EMBODIMENT

Figure 1:
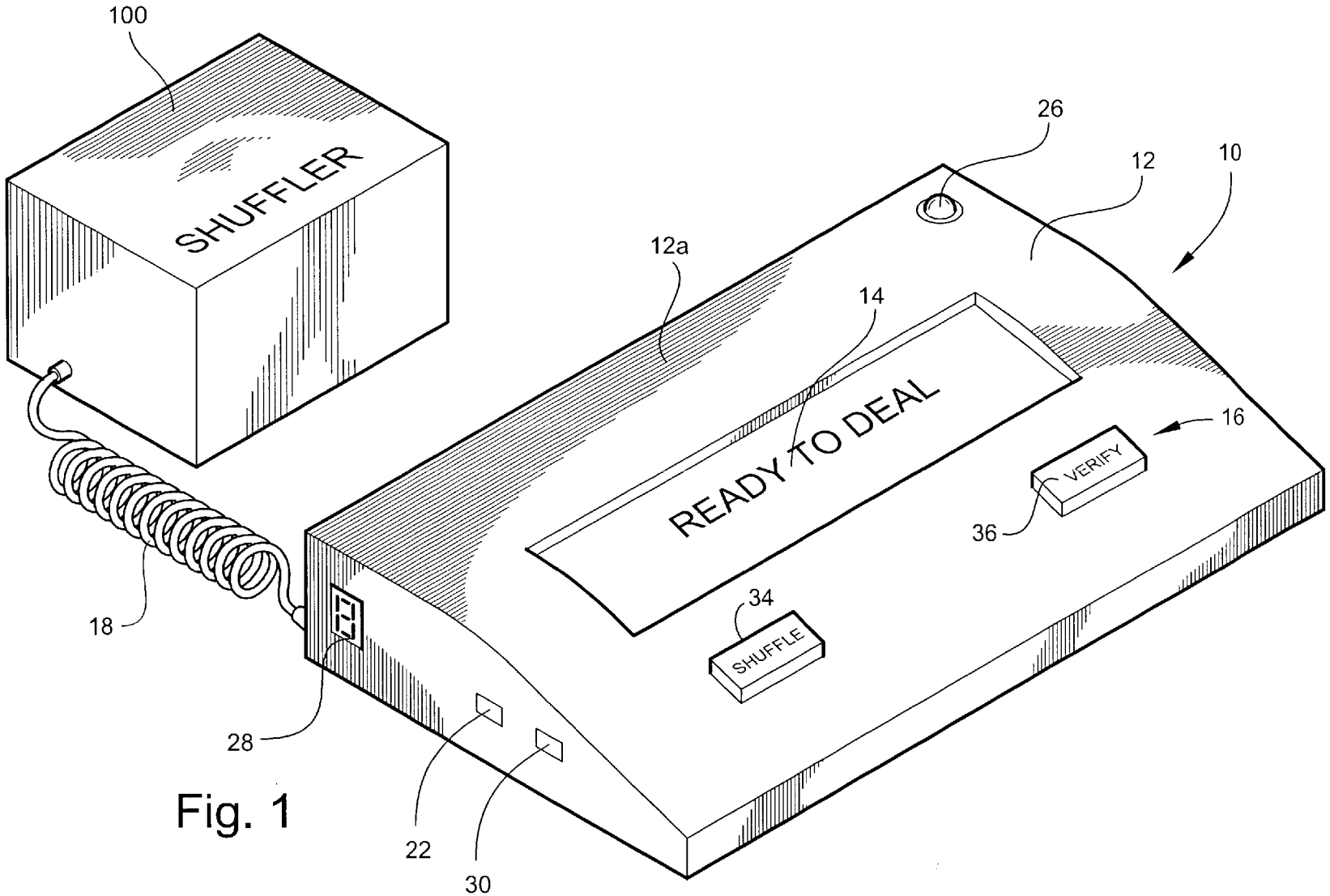
FIG. 1 is a perspective view of a remote control unit in accordance with a first embodiment of the present invention.

With reference generally to FIGS. 1–6, a preferred embodiment of a remote control unit 10 for a playing card shuffling machine 100 is shown. The present invention provides a remote control unit 10 that can be used with a cooperative automatic playing card shuffling machine 100. The unit 10 controls the various functions of the shuffler 100, for example, without limitation, the manner of shuffling, whether the shuffling is in batch or continuous mode; the card game, or games, to be shuffled for or dealt independently or simultaneously, such as Pai-Gow poker, black jack, etc. (it will be understood that the type of card game is not a limitation on the present invention); and the security measures of the shuffler, such as verifying the number of cards in the deck.

The remote control unit 10 generally includes a housing 12, a display 14, a control panel 16, a cord 18 for connecting the remote controller 10 to a shuffling machine 100, and a controller 20. It will be appreciated that terms such as "top," "bottom" and "side" used hereinbelow are used merely for ease of description and refer to the orientation of the components as shown in the Figures. It should be understood that any orientation of the elements of the remote control unit 10 described herein is within the scope of the present invention. It will be further understood that playing card shuffling machines are known in the art. For example, U.S. application Ser. No. 08/847,232, filed May 1, 1997, which is incorporated herein by reference, discloses a playing card shuffling machine.

Figure 2:
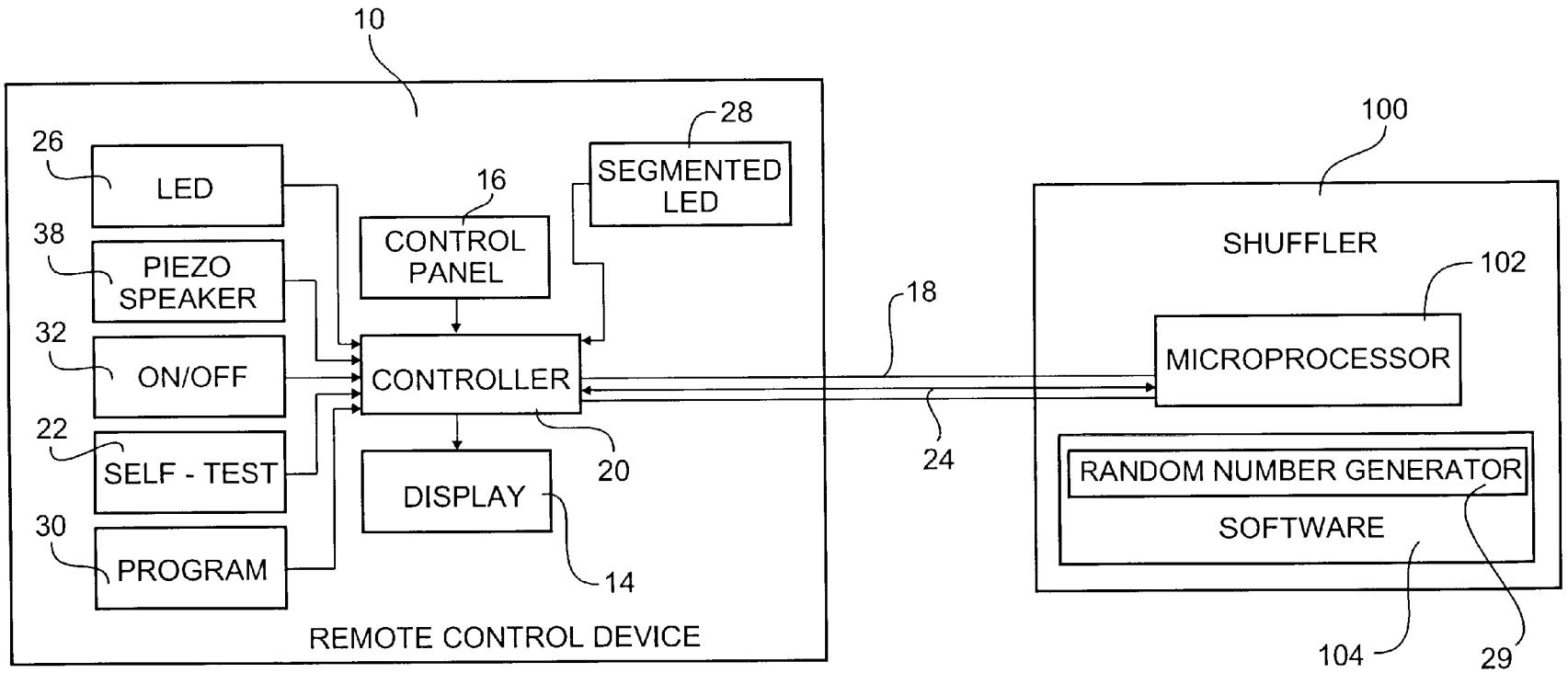
FIG. 2 is a diagrammatic view of the invention showing various components of the remote control unit of FIG. 1 and a shuffler.

As shown in FIGS. 1 and 2, the housing 12 includes a face 12*a* in which is defined a plurality of openings for display 14 and control panel 16. Control panel 16 includes at least one key, and preferably a plurality of keys that are in electrical communication with controller 20. The keys transmit electrical signals that are associated with predetermined commands to controller 20, which in a preferred embodiment of the present invention is a serial interface board. It will be understood that any microprocessor interface can be used including direct extension of the interface bus. Controller 20 then transmits the appropriate signal to a microprocessor 102 associated with the shuffler 100 via circuitry 24.

In a preferred embodiment, controller 20 transmits an interrupt command to the microprocessor 102, so that the present function being performed by the shuffler 100 is interrupted, and the command signal resulting from the pressing of a key is transmitted to the shuffler 100. Keys can be programmed to communicate any desired command, for example, on/off, stop shuffling, start shuffling, verify, program, number of players, etc. Individual key operation will be described more fully herein below. Other keys in electrical communication with controller 20 may be included on the side or bottom of the housing 12.

For example, in a preferred embodiment, a "service" key 22 may be included on the side or bottom of the unit 10.

When the "service" key is pressed, the unit 10 cycles through a series of different self tests for testing the sensors and functions of the shuffler 100. The operator can choose the desired self test. It may also be desirable therefore to include the key/button that controls which game, or games is/are being played (program key 30; described below) on the side or bottom of the unit. Also, any of the keys may be inset on the housing so that it is difficult to access and cannot be accidentally depressed.

Preferably, the housing 12 is made of sheet metal (such as aluminum), durable plastic or other tough, durable materials. The keys are preferably tactile feedback keys, and include indicia thereon for identifying the command the key communicates to the microprocessor 102. The keys can also be made of silicon ribber-carbon as is typical for such keys, or the key pad can be a membrane keypad. Controller 20 (and ultimately-microprocessor 102) controls the operation of the remote control unit 10 by accepting input data from control panel 16, displaying output data on display (LCD) 14. However, it will be understood that other display technologies known in the art, for example, vacuum flourescent, flat panel display, and segmented LED's, are within the scope of the present invention.

The operation of selected commands associated with the keys, switches or buttons of the remote control unit 10 will now be described. It will be understood that any of the keys can be included anywhere on the unit 10, including in the control panel 16. The control panel 16 being the key(s) located on the face 12*a* of the housing 12 that are typically used most often. Preferably the unit 10 is powered by the shuffler 100, i.e., power is transmitted from the shuffler 100 through cord 18 to the unit 10. In another embodiment, the remote control may include an "on/off" key 32 (FIG. 5) in communication with controller 20 for turning power to the remote control unit 10 on and off.

Figure 6:
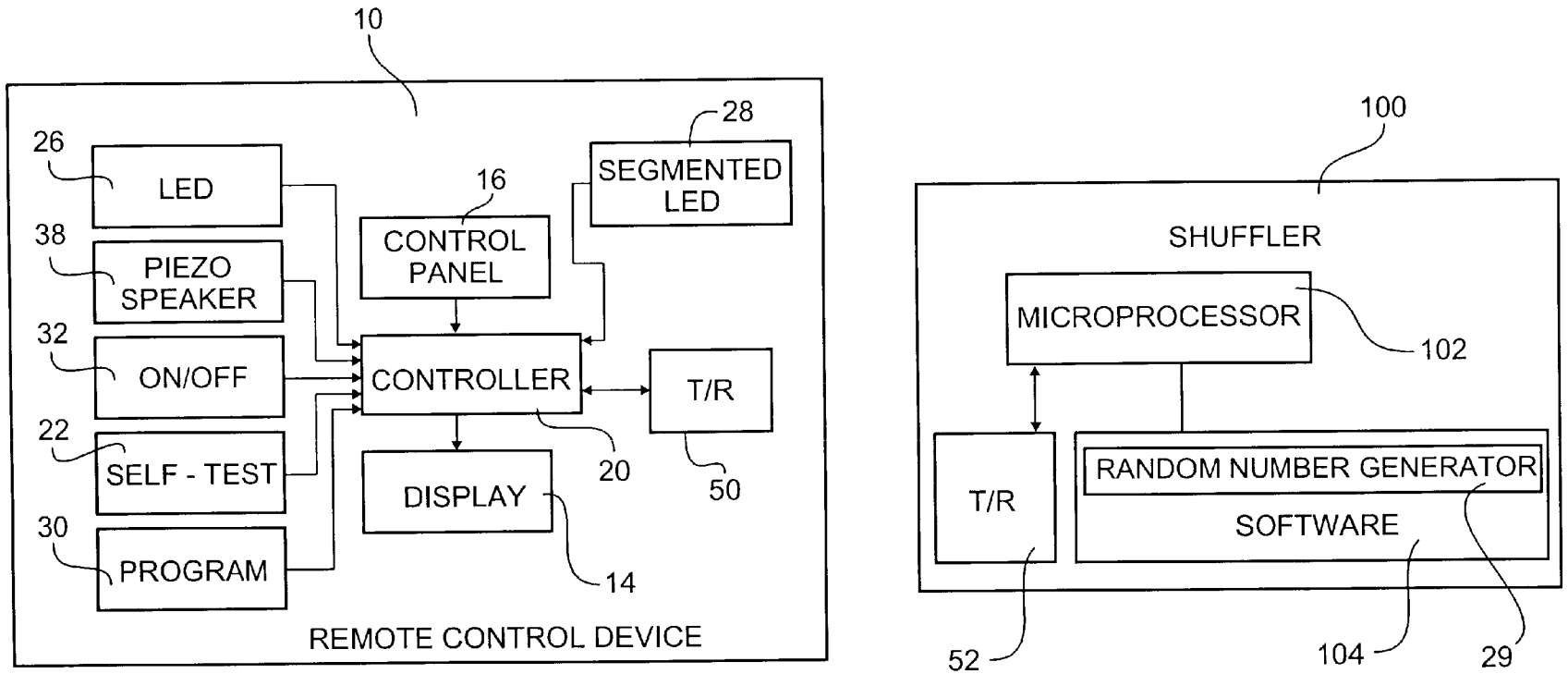
FIG. 6 is a diagrammatic view of the invention similar to FIG. 2 that includes a pair of transmitter/receivers.

The remote control unit 10 can also be powered by batteries or an AC power cord that is communicated directly with the shuffler from an AC outlet. It will be understood that the on/off switch 32 can be located anywhere on the unit 10 or the shuffler 100. For example, the on/off switch 32 may be a rocker-type switch located on the back panel of the unit 10 (as shown in FIG.6). The on/off key 32 can be any latchable pushbutton switch.

The remote control unit 10 can also include a "menu" key 30. The menu key 30 allows the operator to select the type of card game to be played, for example, without limitation, Pai-Gow, Caribbean Stud, Let It Ride, Black Jack, etc. Different card games require different shuffling and/or dealing methods. When the menu key 30 is depressed, the name of a card game appears on the display 14. The operator can cycle through the different games programmed into the microprocessor's memory by repeatedly pressing the menu key 30 until the desired game is selected. In an alternative embodiment, the unit 10 can include separate keys 22 for each different card game.

The unit 10 can include a "verify" key 36. The verify key 36 is provided so that the operator can verify the number of cards that are in the deck at a desired time. The verify key 36 only operates when pressed at the end/beginning of a game/dealing sequence. If the verify key 36 is pressed during a game, it will be ignored. Via the microprocessor 102, the unit 10 keeps track of the number of cards that have been dealt during a dealing sequence. After a game, when the verify key 36 is pressed, the remaining cards are ejected out of the shuffler 100 into the collection area and counted as they are ejected. This number is added to the number of cards that have been dealt to verify that there is a correct amount of cards in the deck (for example, 52, if one deck is being used). If the number of cards counted is incorrect, the dealer is notified, for example, by a phrase on the display 14, flashing of an LED 26 (described below), and/or an audible sound.

Figure 3:
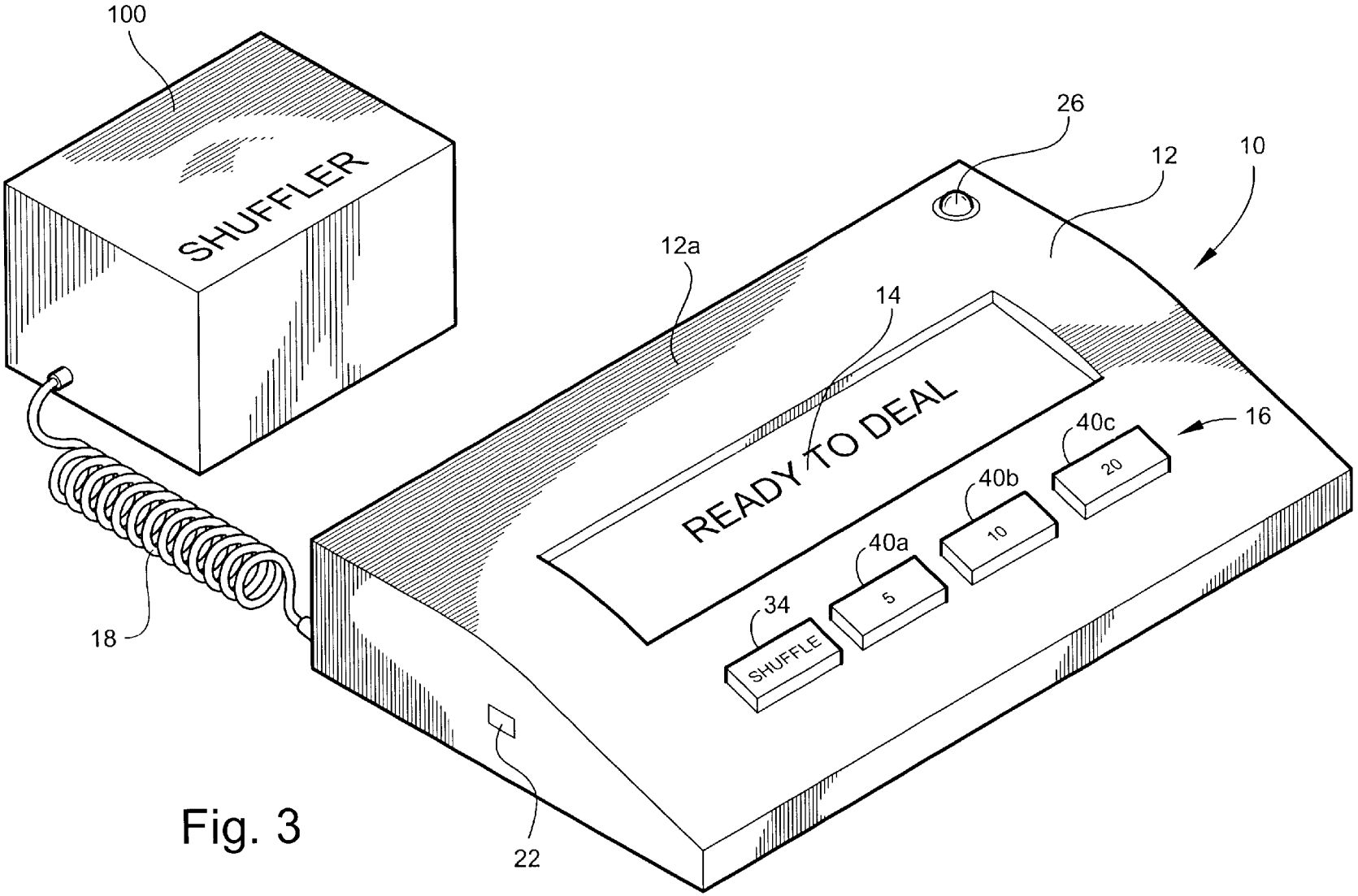
FIG. 3 is a perspective view of a remote control unit in accordance with a second embodiment of the present invention.

The unit 10 can also include a key or keys that prompt the shuffler 100 to deal a certain number of cards (designated "5," "10" and "20" ) 40*a*, 40*b*, 40*c* in FIG. 3, although it will be understood that any number is within the scope of the present invention). For example, in black jack, it is never known how many cards will be dealt during a game. Therefore, after the initial hands, the dealer may estimate that he/she will need 10 more cards. Therefore, he/she can press the "10" key 40*b*, and the shuffler 10 will eject 10 more cards.

Figure 5:
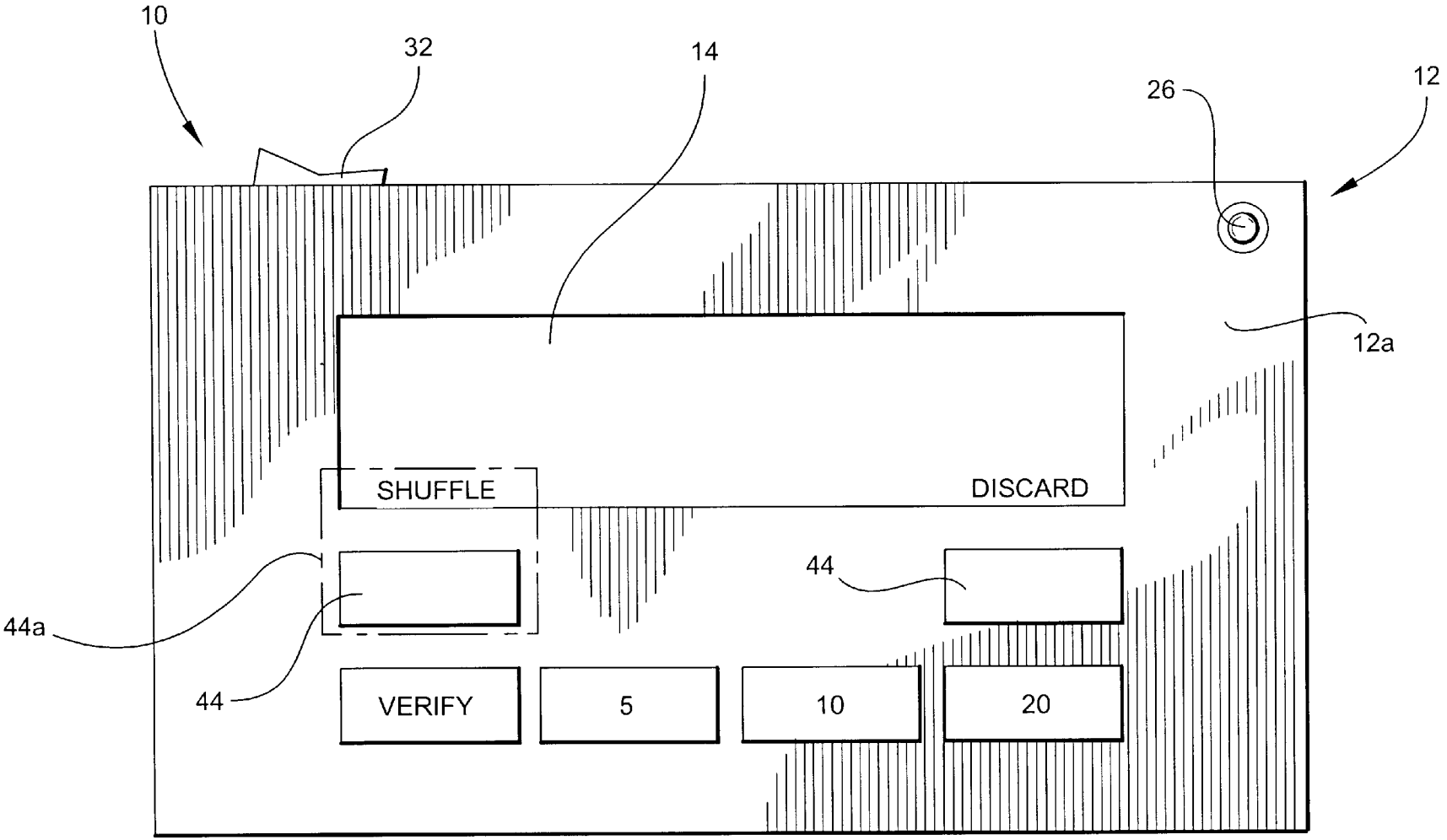
FIG. 5 is a top plan view of a remote control unit in accordance with a third embodiment of the present invention showing the display and the control panel having soft keys.

As shown in FIG. 1, in a first embodiment of the present invention, the remote control unit 10 includes a rocker type on/off switch 32 (as shown in FIG. 5) located on the rear panel, a "service" key 22 and "menu" key 30 on a side panel, and a control panel 16 that includes a "shuffle" key 34 and a "verify" 36 key. It will be understood that the "shuffle" key 34 can be marked "deal", "go" or any other word or phrase that indicates that the shuffler 100 is to initiate a card shuffle.

As shown in FIG. 3, in a second embodiment of the present invention, the remote control unit 10 includes a rocker type on/off switch 32 (as shown in FIG. 5) located on the rear panel, a "service" key 34 and "5," "10" and "20" keys 40*a*, 40*b*, 40*c*. This embodiment is preferably used with a shuffler operating In continuous mode.

Figure 4:
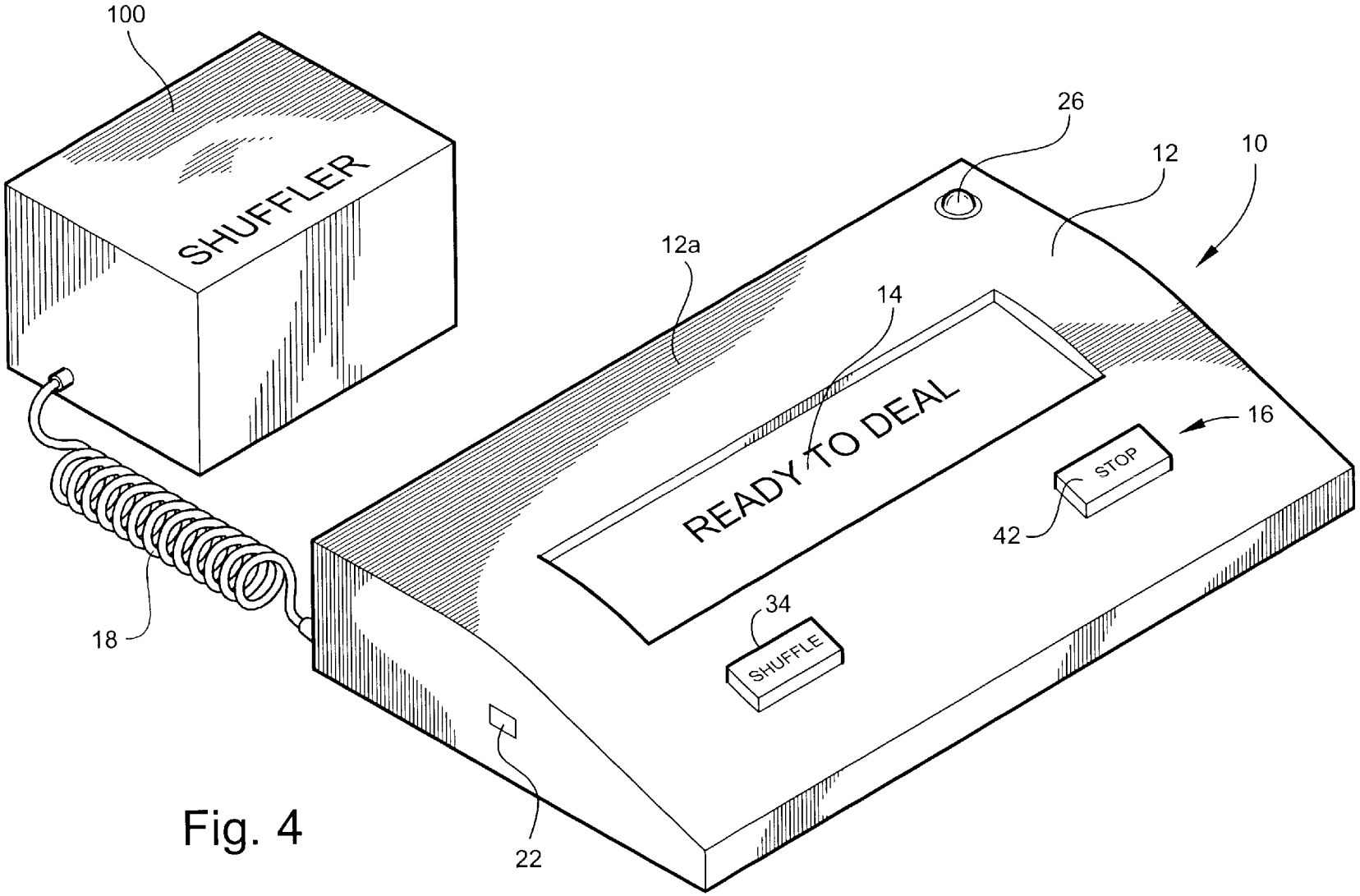
FIG. 4 is a perspective view of a remote control unit in accordance with a third embodiment of the present invention.

As shown in FIG. 4, in a third embodiment of the present invention, the remote control unit 10 includes a rocker type on/off switch 32 (as shown in FIG. 5) located on the rear panel, a "service" key 22 on a side panel, and a control panel 16 that includes a "shuffler" key 34 and a "stop" key 42. This embodiment is preferably used with a shuffler operating in batch mode.

It will be understood that the microprocessor 102 can be associated with software 104 that allows the shuffler 100 to be used in any of the applications referenced herein.

The unit 10 can also include other keys, such as "number of players," or a key that enters the number of cards that have been dealt to each player or a key for selecting the mode of the shuffler, namely, continuous mode, batch mode, the game or games being played, or specialty game mode. The function of the various keys, switches or buttons recited herein is intended to be merely exemplary, and those skilled in the art will be able to make numerous modifications and additions to them without departing from the spirit of the present invention. Moreover, various keys may be soft keys 44, the function of which is defined by the bottom line on the display 14. This is indicated in FIG. 5 by box 44*a*. The soft keys 44 are preferably located on the top row of the control panel 16 and are adjacent to the display 14. The function of the soft keys 44 may change, for example, with the type of game that is selected. This allows for a plurality of functions to be performed while minimizing the number of keys needed.

Referring again to FIGS. 1–2, the remote control unit 10 is programmed to communicate appropriate signals to the display 14 to indicate to the operator what function is being performed by the shuffler 100, or what function should be performed next by the operator. For example, while the shuffler 100 is shuffling, the word "running" appears on the display 14. After shuffling is complete, the phrase "select game is . . . " appears on the display 14, as shown in FIG.

1. In another embodiment, the controller 20 can be programmed with different languages, such as French, Spanish, Italian, etc. A key can be included for cycling through the various language choices.

In operation, when any key, switch or button is activated by depressing, switching or the like, a signal is electrically transmitted to controller 20. A predetermined command is transmitted then from the controller 20. A predetermined command is transmitted then from the controller 20 to the shuffler 100 via transmission means. The shuffler 100 then performs the function associated with the command.

As described above, the transmission means can be a cord 18, including circuitry 24, connected at one end to the remote control unit 10 and at its opposite end to the shuffler 100. However, remote control unit 10 can interface with shuffler 100 in a number of different ways. For example, cord 18 can be omitted, thereby allowing "cordless" operation of remote control unit 10 and providing greater freedom of movement of the remote control unit 10. As shown in FIG. 6, the "cordless" remote control unit 10 includes a transmitter/receiver "T/R" 50 to send commands and data to transmitter/receiver "T/R" 52, which is located on the shuffler 100. The transmitter/receivers 50, 52 can be an infrared transmitter/receiver or a radio frequency transmitter/receiver that include associated antennas.

In a preferred embodiment, the remote control unit 10 includes an indicator for indicating an error condition. Preferably, the back light of the display 14 flashes to indicate an error condition. In another embodiment, the indicator is a light emitting diode (LED) 26 mounted at a location on the remote control unit. The LED 26 is electrically connected to controller 20 to indicate an error condition. Such error conditions may include, but are not limited to, malfunction of the shuffler, such as a mis-shuffle or a jam in the shuffler, a failure in the electronics, bad deck count, i.e., too many or too few cards in the deck (see the description of the "verify" key above), empty supply tray, etc. When the controller 20 receives an error signal, the controller 20 communicates a signal to the LED 26, thereby activating the LED 26 to indicate the error condition to the operator. Preferably, the display 14 indicates to the operator what the error condition is.

In a preferred embodiment, the unit 10 includes a device for emitting an audible signal when an error condition is detected. For example, a speaker 38 such as an electromagnetic or piezoelectric speaker or the like that emits a beep or buzz when an error condition is detected. Preferably, the electro-magnetic speaker 38 is in communication and cooperates with the LED 26.

Referring to FIGS. 1 and 2, preferably, the remote control unit 10 is programmed to provide commands to the shuffler 100 to shuffle and deal for the game Pai-Gow poker. As will be appreciated by those skilled in the art, in Pai-Gow poker, seven hands are always dealt, and the player that goes first is chosen by chance. Typically the player to be dealt to first is chosen by rolling dice. In a preferred embodiment, the present invention includes a segmented LED 28, as shown in FIG. 2 that is electrically connected to the microprocessor 102 in shuffler 100, which includes within the software 104 a random number generator 29.

In operation, when the remote control unit 10 is prompted by the operator to command the shuffler 100 to shuffle and deal a game of Pai-Gow poker, the random number generator generates a number between 1 and 7. The number is then electrically communicated to and displayed on the segmented LED 28. Preferably, a segmented LED 28 is located on both sides of the remote control unit 10 so that all players sitting around a semi-circular table can see the number. It will be understood that the segmented LED(s) 28 can be located anywhere on the housing 12 of remote control unit 10. Furthermore, the number generated by the random number generator 29 can be displayed on the display 14, as well as the segmented LED 28, or on the display 14 alone. In an alternative embodiment, the random number generator can be associated with the remote control unit 10.

In a preferred embodiment, the shuffler 100 includes a switch or key (not shown) for turning on and off the random number generator option. Therefore, when the random number generator is switched off, a game of Pai-Gow poker can be dealt without generating a random number.

Figure 7:
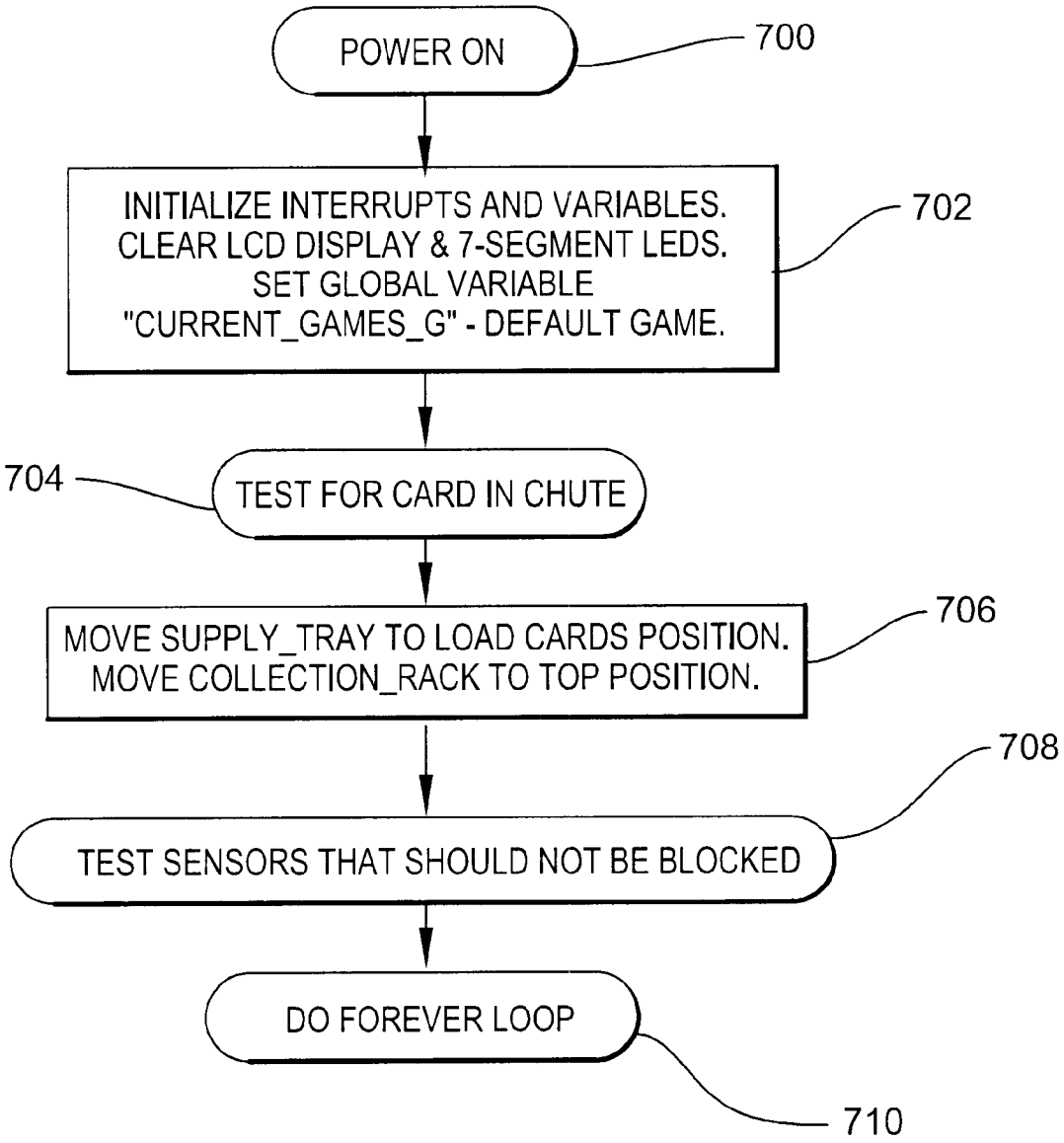
FIG. 7 is a flowchart illustrating operations of software stored in the shuffling machine.

With reference to FIG. 7, a flowchart illustrating operations of the software 104 is shown. The software 104 can either be stored as firmware in an application specific memory chip, in a solid state non-volatile memory device or on a magnetic disk from which the software is loaded when power is turned into an addressable RAM in shuffler 100. When the shuffler 100 is first powered on step 700, the software 104 initializes interrupts and variables, clears the LCD display 14 and the segment LEDs, e.g. 26, on the remote unit, and sets a global variable called game G to a default game, step 702.

Figure 8:
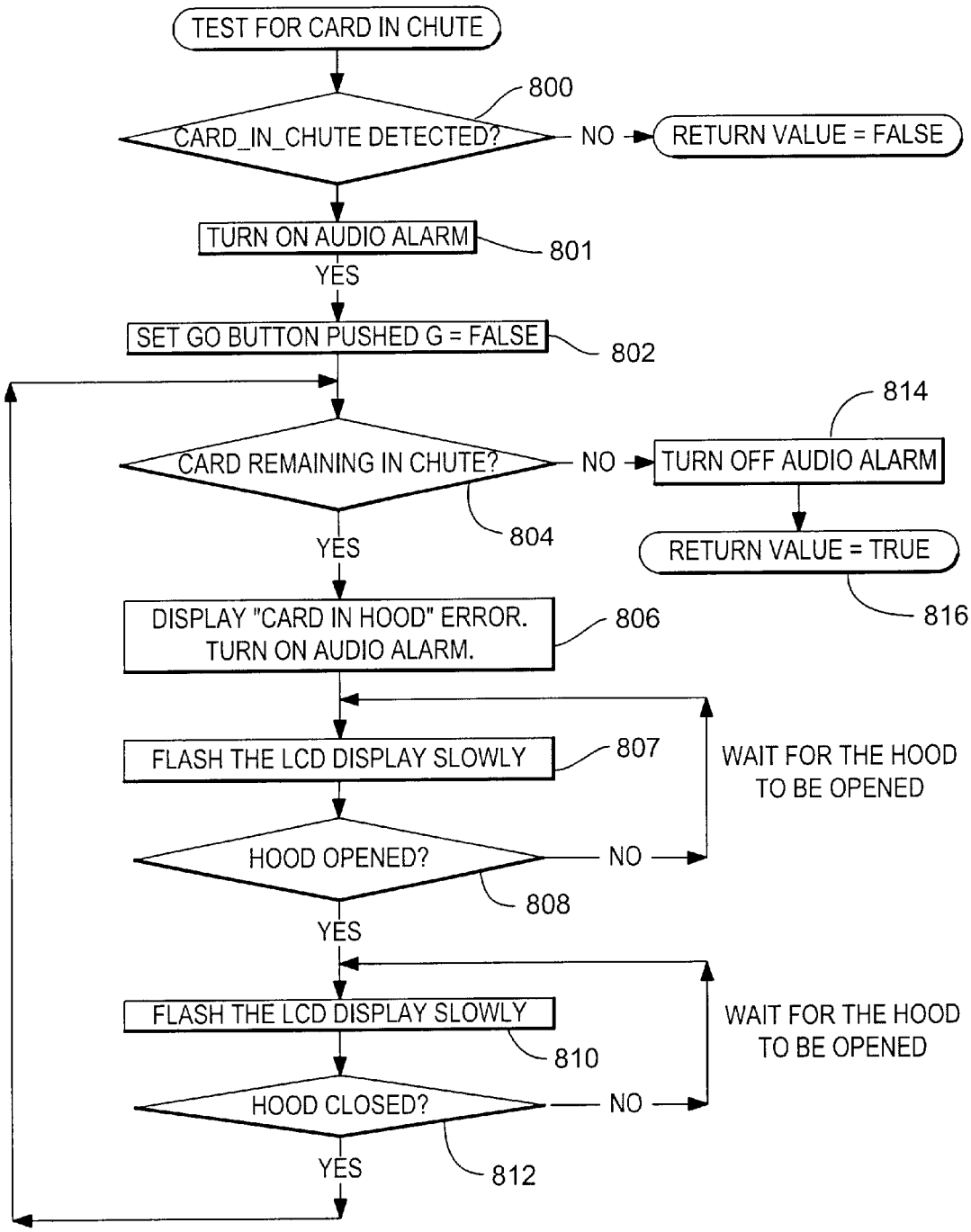
FIG. 8 is a flowchart illustrating the steps executed by the software for testing for whether a card is in the chute of the shuffling machine.

Next, the software initiates a test to see if there is a card in the chute of the shuffler 100, step 704. With reference to FIG. 8, a flowchart illustrating the steps executed by the software 104 for testing for a card in the chute is shown. The software 104 receives input from sensors, which cause a variable named card-in-chute to be set to true, step 800. If a card is detected in the chute, the software turns on an audio alarm, step 801, and clears a variable called go_button_pushed_G to the value of false indicating to the shuffler 100 that any shuffling operations should halt until the card is cleared from the chute, step 802.

The chute sensors are checked again for indication of a card in the chute, step 804. If the sensors still indicate that a card is in the chute, a message is displayed on display 14 indicating that a card is in the chute, step 806. The software 104 causes the LCD 26 to flash slowly, step 807. The software then checks the hood sensors to determine if the hood has been opened, step 808. The system waits until the hood is opened, which would indicate that a person is trying to clear the card from the chute by looping step 806 repeatedly until the hood is opened. After the hood is opened, the software 104 continues to flash the LCD 26 slowly, step 810, until the hood is closed once again, step 812. Processing moves back to 804. If the card has been cleared, the audio alarm is turned off, step 814, and processing returns to the calling subroutine, step 816.

Figure 9:
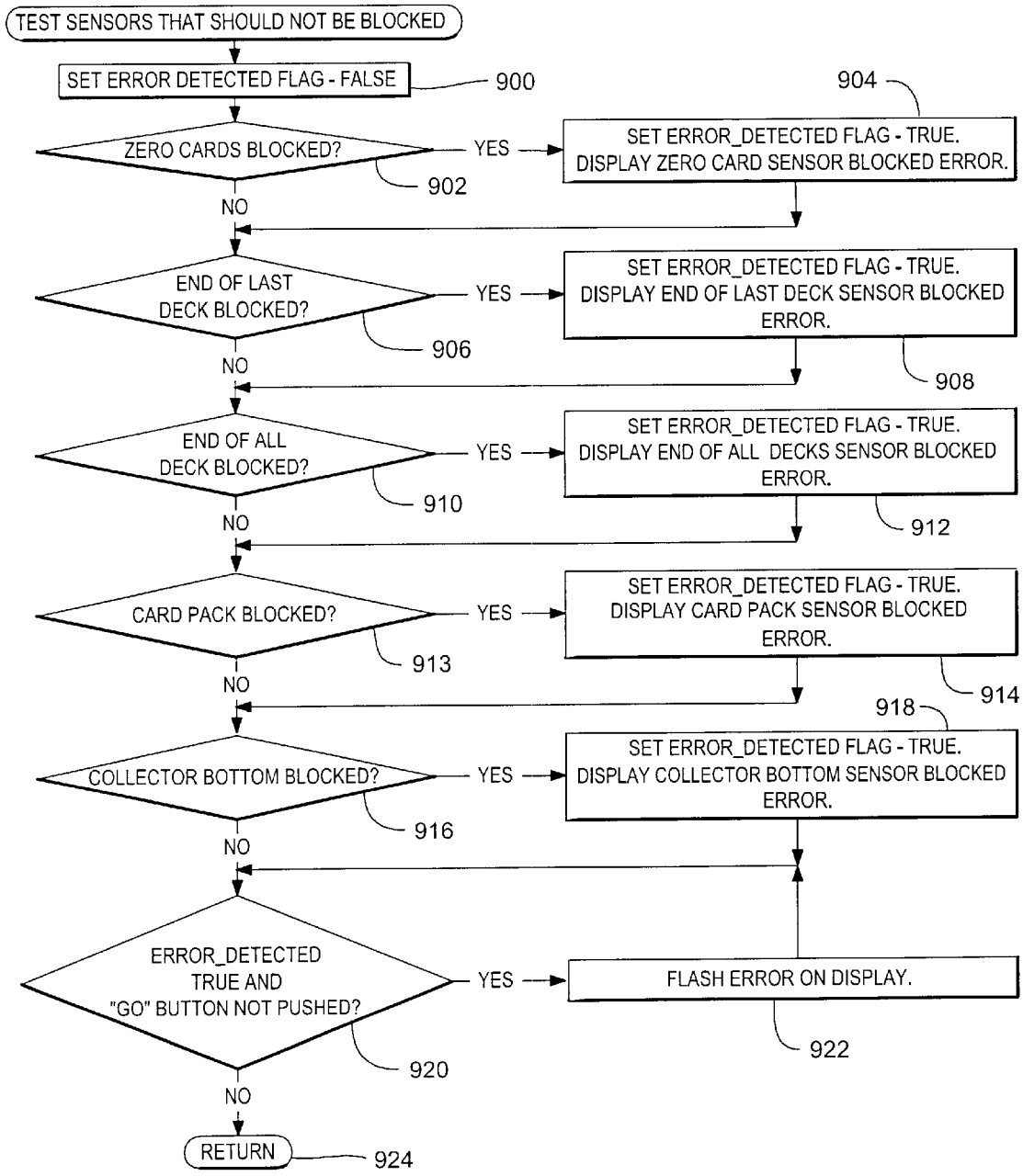
FIG. 9 is a flowchart illustrating the steps executed by the software for testing the status of sensors in the shuffler.

Referring back to FIG. 7, the software then causes the card supply tray to move into the load position, step 706. The system then checks the status of sensors on the shuffler 100, step 708. With reference to FIG. 9, the subroutine operations for testing the status of sensors in the shuffler 100 is shown. An error detected flag is set to false, step 900. The system first checks a zero cards blocked sensor in the shuffler 100, step 902 which indicates if cards are set in position in the supply tray. If the zero cards sensor is blocked, the error detected flag is set to true, and the software 104 displays an error on the display 14, step 904. If an end of last deck sensor is blocked, step 906, which indicates if the stack of cards does not have a sufficient number of decks for the selected game(s), then the error detected flag is set, and an error message is displayed on the display 14, step 908. If an end of all decks sensor is blocked, step 910, which indicates if there are enough cards for a game, or games, then the error detected flag 912 is set to true, and an error message is displayed on the display 14, step 914. If a card pack sensor is blocked, step 913, then the error detected flag is set to true, and an error message is displayed on the display 14, step 914. If a collector bottom sensor is blocked, step 916 which indicates whether the card collector is at the bottom of the card collector, then the error detected flag is set to true, and an error message is displayed on display 14, step 918. At the end of the subroutine, the software 104 checks the error detected flag for a true condition or for a failure of the user to push the go button, step 920. If either condition is met, the error is displayed on the display 14, if a message has not already been displayed, step 922. Processing then loops until there are no sensors blocked, and the go button is pushed. If the error detected flag is false, and the go button has been pushed, the system returns from the subroutine, step 924.

Figure 10A:
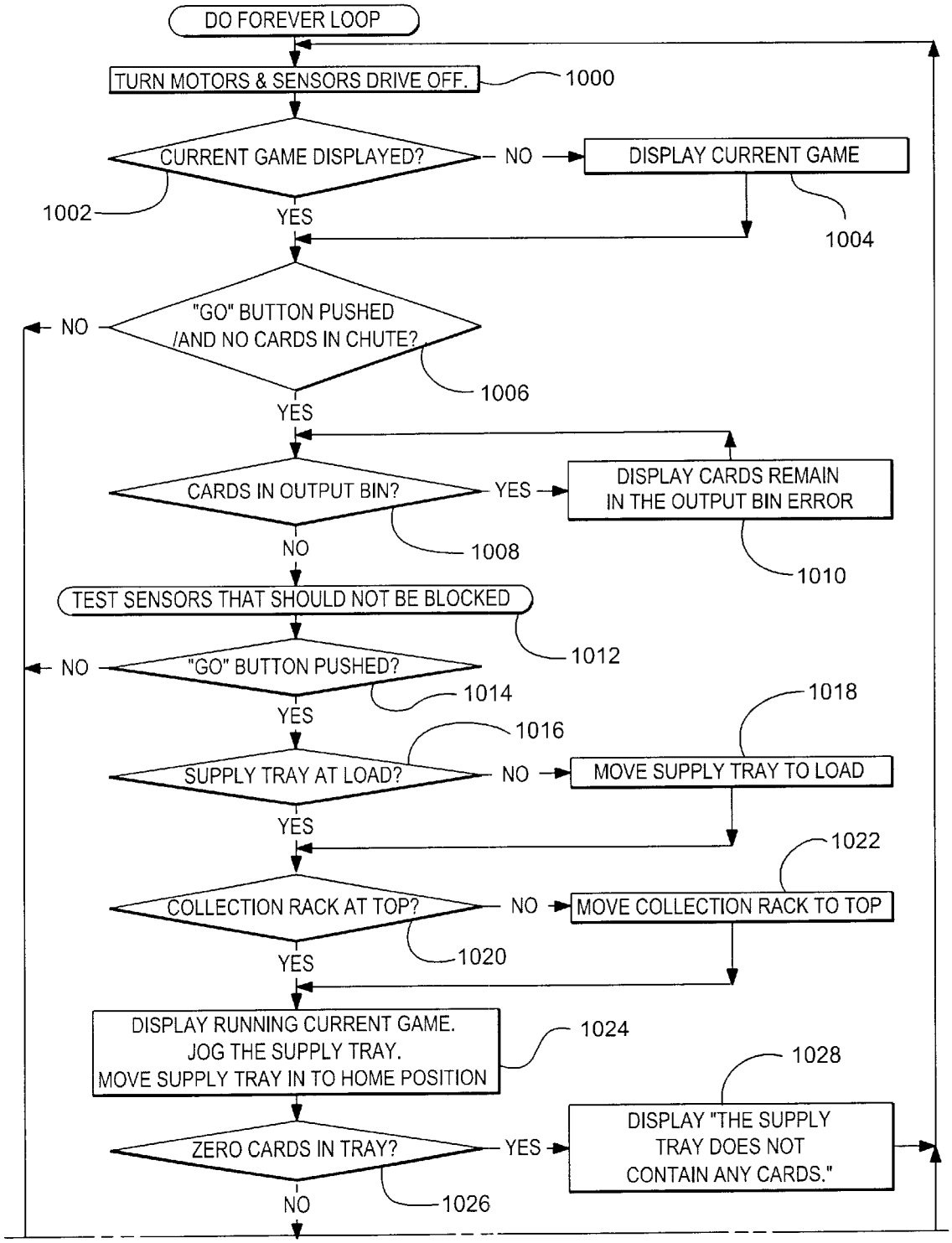
FIG. 10 is a flowchart illustrating the steps executed by the main loop of software.
Figure 10B:
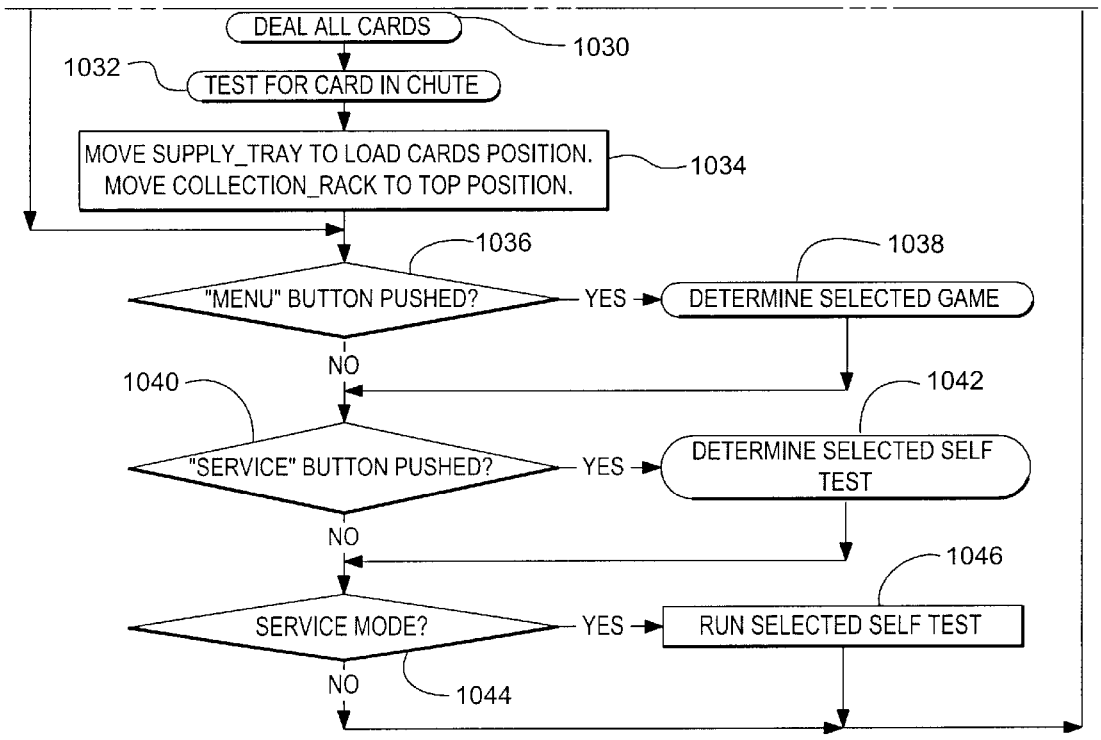

With reference back to FIG. 7, after testing the sensors for a blocked condition, the processing moves to a continuous loop, step 710. With reference to FIG. 10, the continuous loop step 710, for processing the software 104 is shown. The software first causes the motors and sensors for the shuffler to turn off, step 1000. The system then checks if the current game(s) for which the shuffler is configured has been displayed already, step 1002. If not, the current game(s) is/are displayed, step 1004, which may be the default game(s) the first time the loop is processed. Next, the software checks if the go button has been pushed and if there are cards in the chute, step 1006. If the go button has been pushed and there are no cards in the chute, the software checks sensors in shuffler 100 for cards in the output bin, step 1008. If there are cards in the output bin, then an error is displayed to the user until the cards are removed, step 1010. Next, the software 100 checks for blocked sensors by calling the test subroutine explained with respect to FIG. 9 above, step 1012.

The software 104 then checks the go_button_pushed_G variable, which should have been set to false if the previous test conditions were not met, step 1014. If the _button_pushed_G variable is set to true, then the software 104 checks the supply tray sensors for load position, step 1018. Next, the software checks a sensor to make sure that the collection rack is in the top position, step 1020. If the collection rack is not in the top position, the software 104 causes the shuffler to move the collection rack into the top position, step 1022.

The software 104 next displays the running game(s) on the display 14, moves or "jogs" the supply tray follower into position, and moves the supply tray into the home position, step 1024. The software 104 then reads the sensors indicating whether there are zero cards in the supply tray, step 1026. If there are no cards in the supply tray, then an error message is displayed on the display 14 indicating that there are no cards in the supply tray, step 1028. The cards are then dealt, step 1030, according to the procedure in FIG. 11 explained below.

Figure 11A:
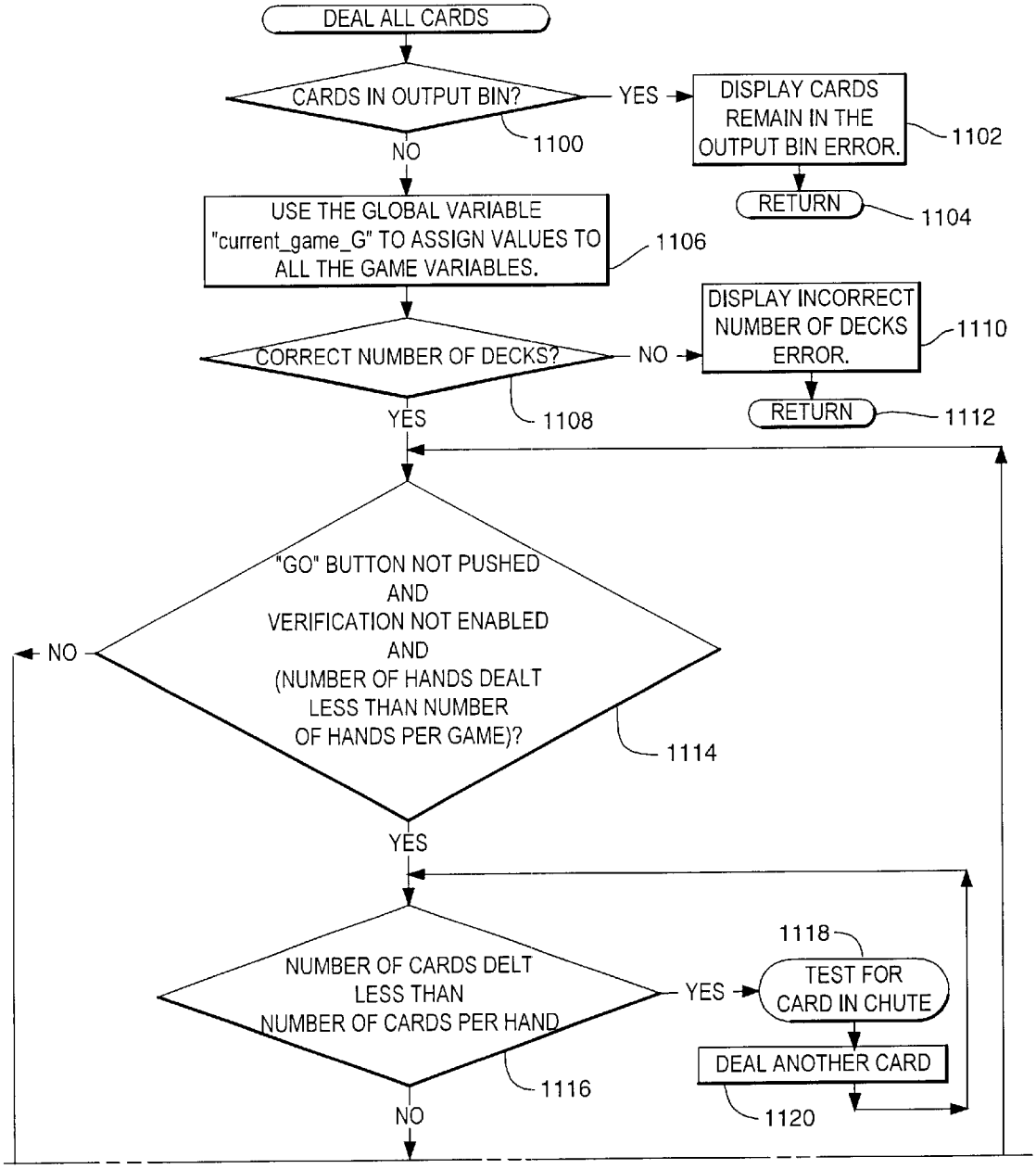
FIG. 11 is a flowchart illustrating the steps executed by the software for dealing cards.
Figure 11B:
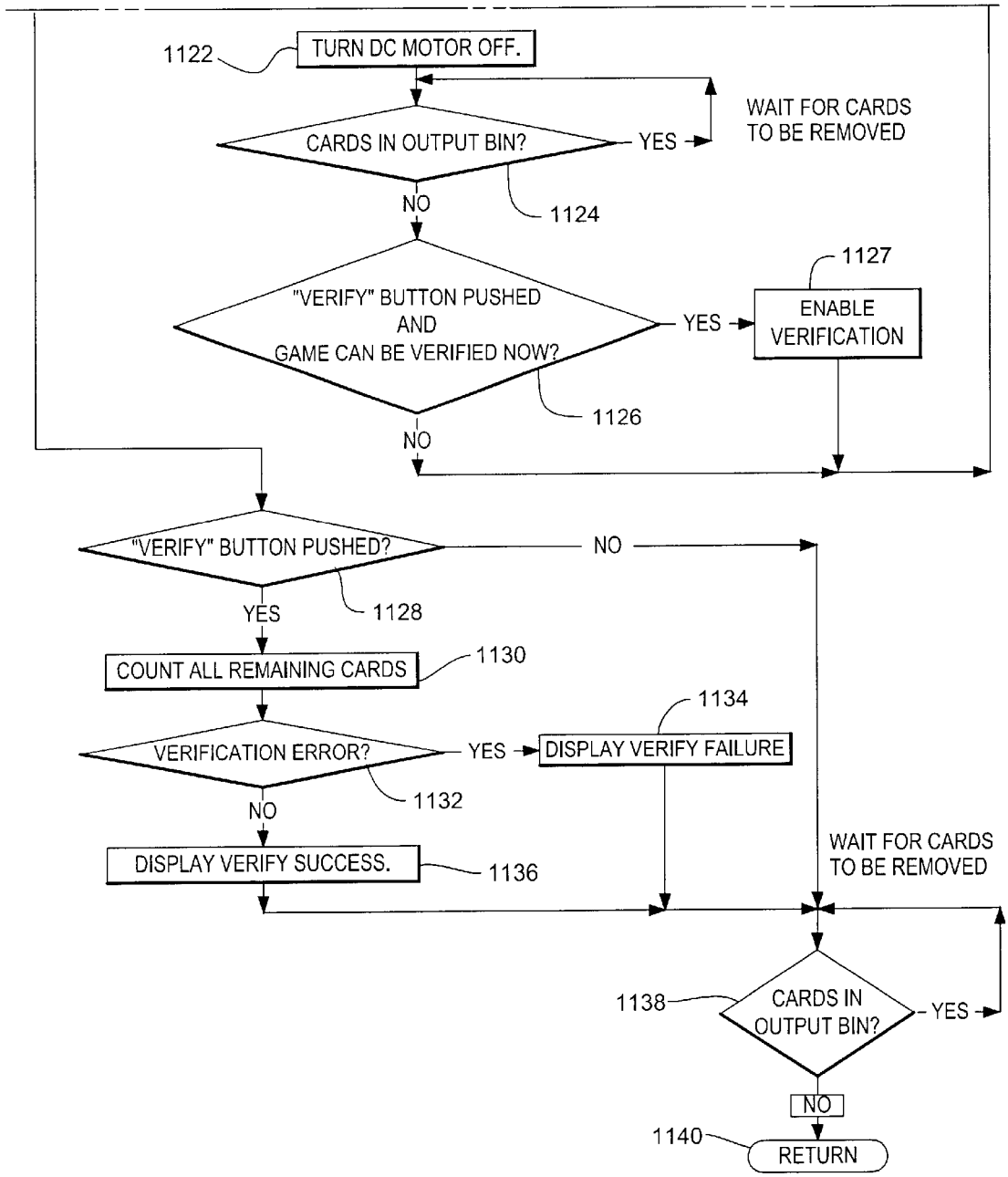

With reference to FIG. 11, a flowchart illustrating the steps taken by a subroutine of the software 104 for dealing cards is shown. The subroutine checks for cards in the output bin, step 1100. If there are cards in the output bin, then an error message is displayed on display 14 indicating that cards remain in the output bin, step 1102, and processing is returned, step 1104. The software 104 then uses the current_game_G variable to assign values to all game variables so that the shuffler can operate according to the specific game (s) being played, step 1106. The software reads a sensor to check if the correct number of decks are in the shuffler 100 for the specific game(s), step 1108. If there are not the correct number of decks, an error is displayed on the display 14, step 1110, and processing is returned form the subroutine, step 1112.

The software next checks if the go_button_pushed_G variable is set to true and if verification is not enabled, step 1114. If those conditions are met, then the software 104 checks if the number of hands dealt is less than the number of hands per game, step 1116. If so, then the software 104 tests for any cards in the chute by calling the subroutine explained above with respect to FIG. 8, step 1118. After any cards are removed from the chute, the software causes another card to be dealt, step 1120. Processing then moves back to step 1116. Once enough cards have been dealt, then the DC motor for the shuffler 100 is turned off, step 1122. The software checks for whether cards are in the output bin, step 1124. If not, the software then checks for whether the verify button has been pushed so that the cards dealt can be verified, step 1126. If the verify button has been pushed, then verification is enabled, step 1127, and processing moves back to step 1114, where the condition in that step is not met.

If the verification button had been pushed, step 1128, then the software 104 directs the shuffler 100 to count all remaining cards, step 1130. If the number of remaining cards are not verified, step 1132, then a verify failure condition is displayed, step 1134. Otherwise, a verification success message is displayed on display 14, step 1136. Processing then moves to step 1138 where the system waits for the cards to be removed from the bin by the dealer. After the cards are removed from the bin, processing is returned from the subroutine, step 1140.

With reference back to FIG. 10, after the cards are dealt, the software 104 calls the subroutine explained with respect to FIG. 8 above to test for whether there is a card in the chute, step 1032. If the chute is clear, the software 104 then causes the shuffler 100 to move the supply tray back into the load position and the collection rack back to the top position, step 1034.

Figure 12:
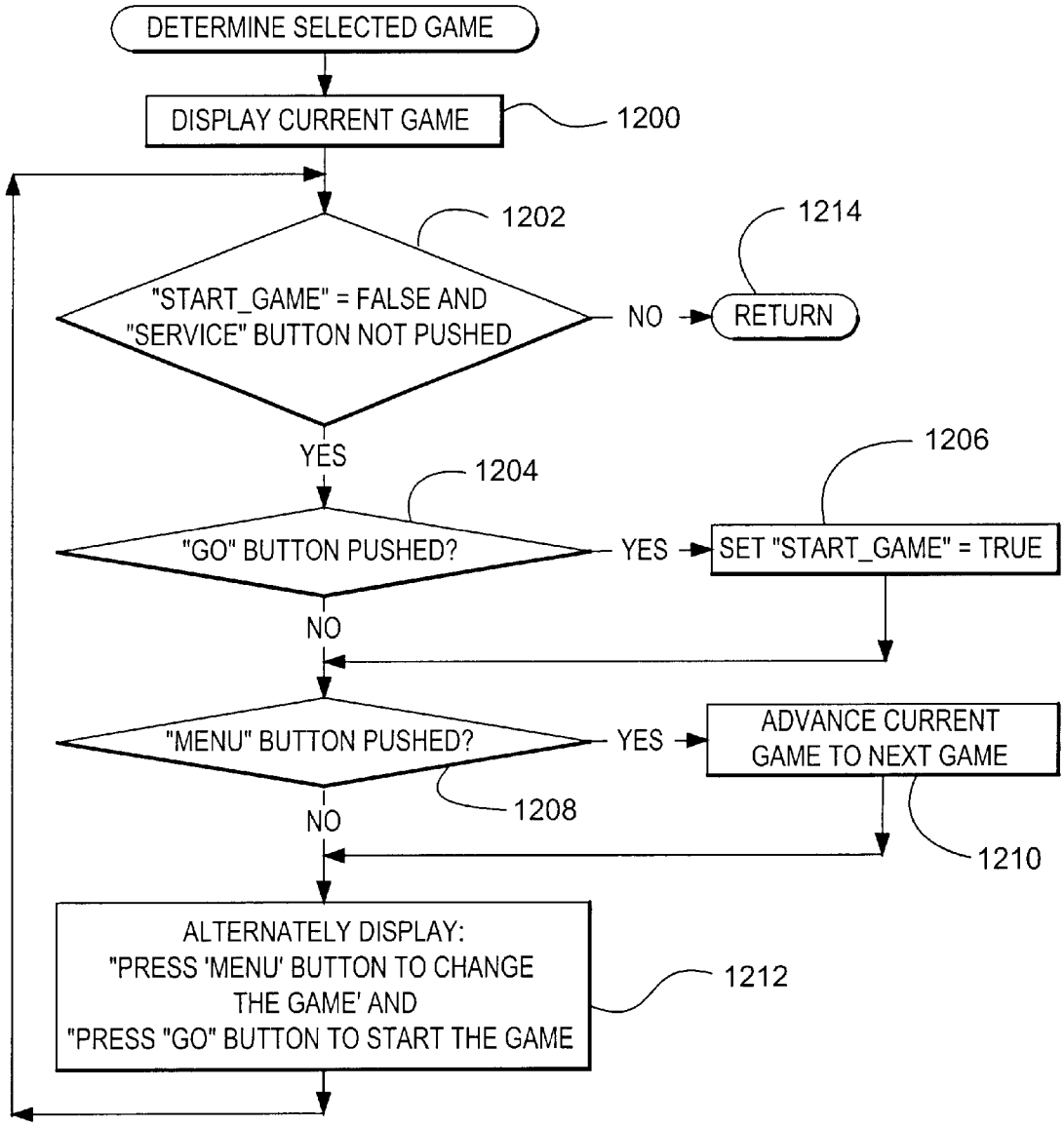
FIG. 12 is a flowchart illustrating the steps executed by the software for allowing selection of a game or mode for shuffling machine operations.

If the user pushes the menu key 30, step 1036, then a list of games is presented on the display 14, step 1038 to allow the user to select a different game, or mode for operating the shuffler 100. The selection may comprise operation of the shuffler 100 in batch or continuous mode. With reference to FIG. 12 a flowchart illustrating operations for the subroutines in the software 104 for allowing selection of a game, a choice of a plurality of games simultaneously, or mode is shown. The current game(s) is/are displayed on the display 14, step 1200. The software 104 checks for the condition of whether the start_game variable is set to false and whether the go button has been pushed, step 1202. If not, the software 104 sets a start_game variable to true, step 1206. If the menu key is pushed, step 1208, then the current game highlighted on the displayed menu is advanced to the next game, step 1210. Throughout menu navigation, instructions are displayed, step 1212. Processing then moves back to step 1202, which returns from the subroutine if the start_game variable had been set to true, step 1214.

Figure 13:
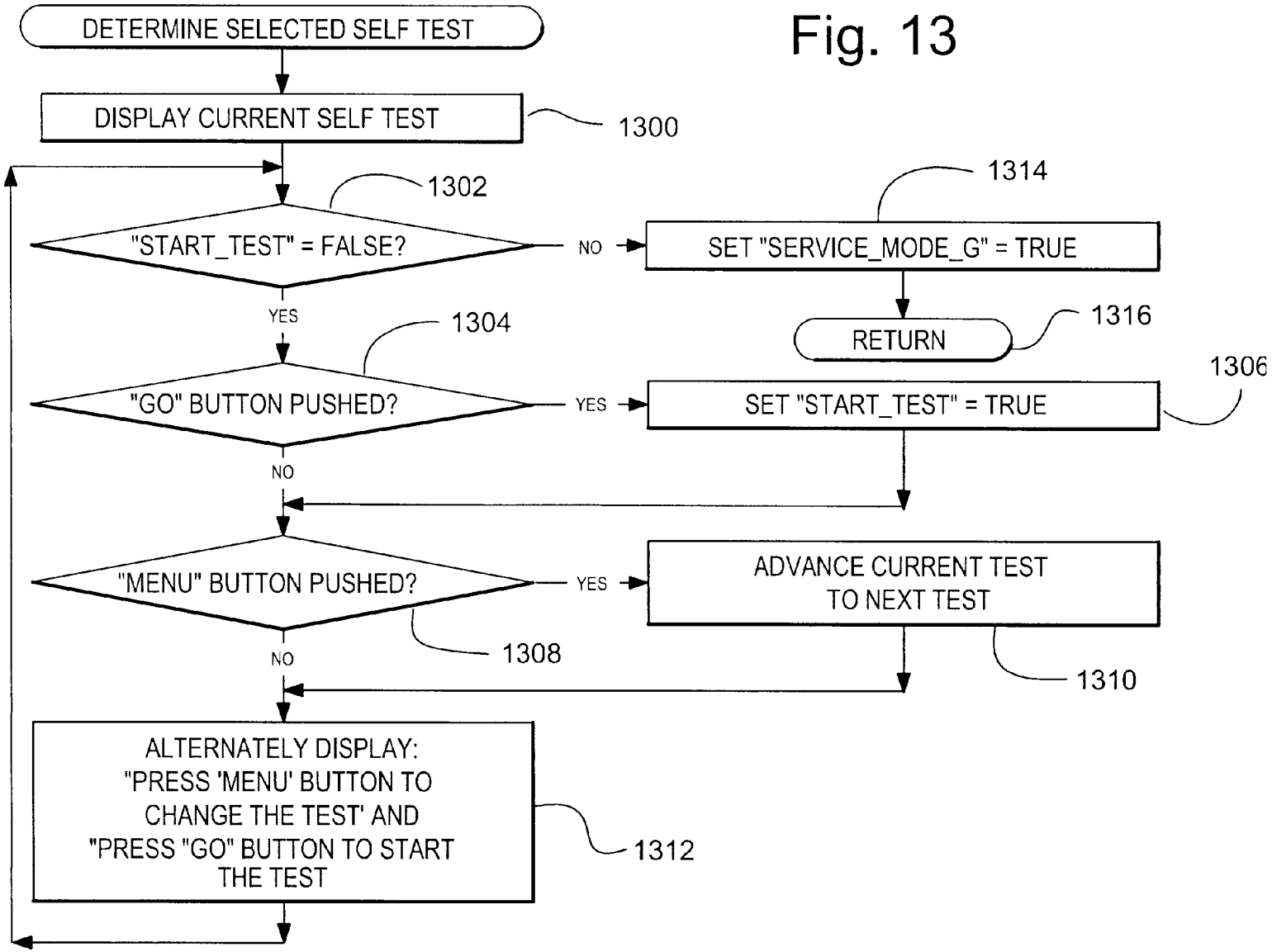
FIG. 13 is a flowchart illustrating the steps executed by the software for allowing selection of a self test for the shuffling machine.

With reference back to FIG. 10, if the user pushes the service key 22, step 1040, then the system calls a subroutine for selecting a self test, step 1042. With reference to FIG. 13, a flowchart illustrating the steps for selecting a self test is shown. The current self test is displayed, step 1300. A start_test variable is tested for a value of false, step 1302. If the value is true, the software 104 checks for actuation of the go button, step 1304. If the go button has been pushed, then the start_test variable is set to true, step 1306. The software 104 checks for actuation of the go button, step 1304. If the go button has been pushed, then the current test selected is advanced to the next test, step 1310. Instructions are displayed on the display 14 during selection of self test, step 1312. Processing moves back to step 1302, wherein if the start_test variable is true, then a service_mode_G variable is set to true, step 1314, and processing is returned from the subroutine, step 1316.

With reference to FIG. 10, the software 104 checks the service_mode_G variable for a value of true, step 1044. If so, then the software 104 runs the selected test on the shuffler 100, step 1046.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its form or modifications within the proper scope of the appended claims appropriately interpreted in accordance with the doctrine of equivalents.

Having thus described the invention, what is desired to be protected by Letters Patent is presented in the subsequent appended claims.

What is claimed is:

1. A remotely-controlled, multi-mode playing card shuffling system, comprising:

a playing card shuffling device; and a remote control unit having a display, said remote control unit electrically coupled to the playing card shuffling device, wherein said remote control unit outputs a menu comprising a list of card games to the display, and wherein when a card game is selected from the list of card games, the playing card unit verifies that a predetermined number of cards required for the card game selected are in the playing card shuffling device and deals the predetermined number of cards required for the card game selected.

2. A remotely-controlled, multi-mode playing card shuffling apparatus, comprising:

a) a playing card shuffling machine having a first housing for selectively shuffling cards for at least two different card games having different card shuffling requirements and adapted to receive at least one deck of unshuffled playing cards at an input area and to discharge shuffled playing cards at an output area, said playing card shuffling machine having microprocessor means having at least two selectable modes of operation, said at least two modes of operation being defined by said at least two different card games, said at least two modes of operation being selectable in response to a mode selection signal produced by an operatively connected remote control unit;

b) controller means disposed within said first housing and operative connection means for operatively connecting to said microprocessor means and adapted to receive at least a mode selection command produced by an operatively connected remote control unit and to create a mode selection signal representative thereof so as to select one of said at least two modes of operation in response thereto, and to transmit the mode selection signal; and said playing card shuffling machine further comprising software for processing executable instructions regarding operation of the playing card shuffling machine c) a remote control unit having a second housing and a command generation means disposed within said remote control unit and disposed remotely from said playing card shuffling machine, and operatively connected to said controller means of said playing card shuffling machine, for generating at least a mode selection command, said remote control unit comprising means for displaying a textual message indicative of a currently selected mode of operation, said display means disposed within said second housing and operatively connected to said controller means.

3. The remotely-controlled, multi-mode playing card shuffling apparatus as recited in claim 2, wherein said controller means is adapted such that the at least two modes of operation further comprise at least a batch shuffling mode and a continuous shuffling mode.

4. The remotely-controlled, multi-mode playing card shuffling apparatus as recited in claim 3, wherein said controller means of said remote control unit is adapted to further comprise at least one test operating mode, each of said at least one test modes of operation being adapted to test at least one condition of said playing card shuffling machine.

5. The remotely-controlled, multi-mode playing card shuffling apparatus as recited in claim 4, wherein said controller means of said remote control unit further comprises memory means adapted for storing at least one executable instruction for allowing selection of said at least two modes of operation.

6. The remotely-controlled, multi-mode playing card shuffling apparatus as recited in claim 5, wherein said operative connection means between said command generation means, and said controller means comprise an electrical cable.

7. The remotely-controlled, multi-mode playing card shuffling apparatus as recited in claim 5, wherein said operative connection means between said command generation means, and said controller means comprise a two-way, wireless communication link.

8. The remotely-controlled, multi-mode playing card shuffling apparatus as recited in claim 5, wherein said memory means is further adapted to contain a list of possible game modes of operation, said display means is adapted to display said list of possible game modes, and wherein at least one of said game modes of operation may be selected from said list of possible game modes of operation.

9. The remotely-controlled, multi-mode playing card shuffling apparatus as recited in claim 8, wherein said message comprises a textual message.

10. The remotely-controlled, multi-mode playing card shuffling apparatus as recited in claim 9, wherein said textual message comprises a menu.

11. The remotely-controlled, multi-mode playing card shuffling apparatus as recited in claim 9, wherein said textual message comprises a status message indicative of a condition of said playing card shuffling machine.

12. A method for switching operating modes of a playing card shuffling machine, the steps comprising:

a) providing a playing card shuffling machine having a first housing and a microprocessor means adapted for selectively shuffling cards for at least two different card games having different card shuffling requirements, thereby defining at least two operating modes, said microprocessor means being capable of changing operating modes upon command in response to an operatively connected remote control unit;

b) providing a remote control unit operatively connected to said playing card shuffling machine, and comprising controller means having a control panel, said control panel adapted for both generating at least a mode changing command and displaying a message indicative of an operating mode of said card shuffling machine and locating said remote control unit remotely from said card shuffling machine;

c) defining at least two operating modes of said card shuffling machine;

d) generating an operating mode selecting command at said control panel of said remote control unit; and e) changing operating modes upon command in response to communication with said control means of said remote control unit;

f) displaying a message indicative of the operating mode of said card shuffling machine on said display.

13. The method for switching operating modes of a playing card shuffling machine as recited in claim 12, wherein said displaying step comprises displaying a menu of operating mode selections, and said generating step further comprises generating said operating mode selecting command by utilizing said menu.

14. The method for switching operating modes of a playing card shuffling machine as recited in claim 13, wherein said defining step further comprises defining at least two modes of operation comprise at least a batch shuffling mode and a continuous shuffling mode.

15. The method for switching operating modes of a playing card shuffling machine as recited in claim 14, wherein said defining step further comprises defining at least two modes of operation comprise at least one test operating mode, each of said at least one test modes of operation being adapted to test at least one function of said playing card shuffling machine.

16. The method for switching operating modes of a playing card shuffling machine as recited in claim 15, wherein said microprocessor means further comprises memory means adapted for storing microprocessor executable instructions for allowing selection of said at least two modes of operation.

17. The method for switching operating modes of a playing card shuffling machine as recited in claim 16 wherein said control panel is operatively connected to said card shuffling machine by an electrical cable.

18. The method for switching operating modes of a playing card shuffling machine as recited in claim 16 wherein said remote control unit is operatively connected to said card shuffling machine by a two-way wireless communications link.

* * * * *